US010182290B2

(12) United States Patent
Ribeiro

(10) Patent No.: US 10,182,290 B2
(45) Date of Patent: Jan. 15, 2019

(54) COVARIANCE MATRIX ESTIMATION WITH ACOUSTIC IMAGING

(71) Applicant: Microsoft Technology Licensing, LLC, Redmond, WA (US)

(72) Inventor: Flavio Protasio Ribeiro, Bellevue, WA (US)

(73) Assignee: MICROSOFT TECHNOLOGY LICENSING, LLC, Redmond, WA (US)

( * ) Notice: Subject to any disclaimer, the term of this patent is extended or adjusted under 35 U.S.C. 154(b) by 0 days.

(21) Appl. No.: 15/440,959

(22) Filed: Feb. 23, 2017

(65) Prior Publication Data

US 2018/0242080 A1 Aug. 23, 2018

(51) Int. Cl.
*H04R 3/00* (2006.01)
*H04R 29/00* (2006.01)

(52) U.S. Cl.
CPC ..... *H04R 3/005* (2013.01); *H04R 29/008* (2013.01); *H04R 2430/03* (2013.01); *H04R 2430/21* (2013.01)

(58) Field of Classification Search
CPC ..... G01S 5/18; G10L 15/20; G10L 21/0208; G10L 21/0232; G10L 2021/02166;
(Continued)

(56) References Cited

U.S. PATENT DOCUMENTS 6,009,045 A 12/1999 Yang et al.
9,231,303 B2 1/2016 Edelmann et al.
(Continued)

OTHER PUBLICATIONS

Capon J., "High-Resolution Frequency-Wavenumber Spectrum Analysis", in Proceedings of the IEEE, vol. 57, No. 8, Aug. 1969, pp. 1408-1418.

(Continued)

*Primary Examiner* — Yogeshkumar Patel
(74) *Attorney, Agent, or Firm* — Alleman Hall Creasman & Tuttle LLP

(57) ABSTRACT

A computing device is provided, comprising a processor configured to receive a set of measurements of a vector x of acoustic data, including noise, interference, and a signal of interest. The processor may express x in a frequency domain discretized in a plurality of intervals. For each interval, the processor may generate an estimate $\hat{S}_x$ of a covariance matrix of x. For each $\hat{S}_x$, the processor may use acoustic imaging to obtain an estimate $\hat{Y}$ of a spatial source distribution. For each $\hat{Y}$, the processor may remove the signal of interest to produce an estimate $\hat{W}$ of a noise and interference spatial source distribution. For each $\hat{W}$, the processor may generate an estimate $\hat{S}_n$ of a noise and interference covariance matrix. The processor may generate a beamformer configured to remove noise and interference from the acoustic data, wherein the noise and interference at each frequency are identified using $\hat{S}_n$.

20 Claims, 7 Drawing Sheets

(58) Field of Classification Search
CPC .... G10K 11/34; H04R 3/005; H04R 2203/12; H04R 3/02; H04S 7/305
USPC ..... 381/66, 71.1, 71.11, 317; 367/119
See application file for complete search history.

(56) References Cited

U.S. PATENT DOCUMENTS

| | | | | |
|---|---|---|---|---|
| 9,721,582 | B1 * | 8/2017 | Huang | G10L 21/0216 |
| 9,759,805 | B2 * | 9/2017 | Dokmanic | G01S 5/18 |
| 2002/0015500 | A1 | 2/2002 | Belt et al. | |
| 2003/0078734 | A1 | 4/2003 | Ozbek | |
| 2003/0231547 | A1 | 12/2003 | Yang | |
| 2004/0138565 | A1 | 7/2004 | Trucco | |
| 2009/0274006 | A1 | 11/2009 | Yockney | |
| 2012/0093344 | A1 * | 4/2012 | Sun | H04R 3/005 381/122 |
| 2012/0140597 | A1 | 6/2012 | Park et al. | |
| 2013/0083943 | A1 * | 4/2013 | Sorensen | H04R 3/005 381/92 |
| 2013/0204114 | A1 | 8/2013 | Huang et al. | |
| 2014/0056435 | A1 * | 2/2014 | Kjems | G10L 15/20 381/66 |
| 2016/0018510 | A1 * | 1/2016 | Dokmanic | G01S 5/18 367/119 |
| 2016/0219365 | A1 | 7/2016 | Elko et al. | |
| 2017/0221502 | A1 * | 8/2017 | Huang | G10L 21/0216 |

OTHER PUBLICATIONS

Vertatschitsch E. et al., "Nonredundant Arrays", in Proceedings of the IEEE, vol. 74, No. 1, Jan. 1986, 1 page.
Rudin L. et al., "Nonlinear total variation based noise removal algorithms", Physica D: Nonlinear Phenomena, vol. 60, Issues 1-4, Nov. 1992, pp. 259-268.
Underbrink J. et al., "Array design for non-intrusive measurement of noise sour ces.", in Proceedings of Noise-Con, vol. 2, 1996, pp. 757-762.
Chen S. et al., "Atomic Decomposition by Basis Pursuit", SIAM Journal on Scientific Computing, vol. 20, No. 1, Aug. 1998, pp. 33-61.
Srebro N. et al., "Weighted Low-Rank Approximations" in Proceedings of the Twentieth International Conference on Machine Learning (ICML-2003), Aug. 21, 2003, Washington, DC, 8 pages.
Donoho D. et al., "Sparse nonnegative solution of underdetermined linear equations by linear programming", in Proceedings of the National Academy of Sciences of the United States of America, vol. 102, Issue 27, Jul. 5, 2005, pp. 9446-9451.
He L. et al., "MR Image Reconstruction by Using the Iterative Refinement Method and Nonlinear Inverse Scale Space Methods", UCLA CAM Rep., vol. 6, Available as Early as Jun. 23, 2006, 15 pages.
Hale E. et al., "A Fixed-Point Continuation Method for I1-Regularized Minimization with Applications to Compressed Sensing" CAAM Technical Report TR07-07, Jul. 7, 2007, 45 pages.
Kim S., et al., "An Interior-Point Method for Large-Scale I1-Regularized Least Squares", IEEE Journal of Selected Topics in Signal Processing, vol. 1, No. 4, Dec. 2007, pp. 606-617.
Figueiredo M. et al., "Gradient Projection for Sparse Reconstruction: Application to Compressed Sensin and Other Inverse Problems", IEEE Journal of Selected Topics in Signal Processing, vol. 1, No. 4, Dec. 2007, pp. 586-597.
Van Den Berg E. et al., "Probing the Pareto Frontier for Basis Pursuit Solutions", SIAM Journal on Scientific Computing, vol. 31, No. 2, Nov. 26, 2008, pp. 890-912.
Blacodon D., "Spectral Estimation Method for Noisy Date Using a Noise Reference", in Proceedings of the Third Berlin Beamforming Conference, Feb. 24, 2010, Berlin, Germany, 16 pages.
Gu, et al., "Robust Adaptive Beamforming Based on Interference Covariance Matrix Reconstruction and Steering Vector Estimation", in Journal of IEEE Transactions on Signal Processing, vol. 60, Issue 7, Jul. 2012, pp. 3881-3885.
Lorenz, et al., "Robust Minimum Variance Beamforming", in Journal of IEEE Transactions on Signal Processing, vol. 53, Issue 5, May 2005, pp. 1684-1696.
Mallipeddi, et al., "Robust Adaptive Beamforming Based on Covariance Matrix Reconstruction for Look Direction Mismatch", in Progress in Electromagnetics Research Letters, vol. 25, 2011, pp. 37-46.
Ribeiro, et al., "Fast Near-Field Acoustic Imaging with Separable Arrays", in Proceedings of IEEE Statistical Signal Processing Workshop, Jun. 28, 2011, pp. 429-432.
Ribeiro, et al., "Fast Transforms for Acoustic Imaging—Part I: Theory", in Journal of IEEE Transactions on Image Processing, vol. 20, Issue 8, Aug. 2011, pp. 2229-2240.
Ribeiro, et al., "Fast Transforms for Acoustic Imaging—Part II: Applications", in Journal of IEEE Transactions on Image Processing, vol. 20, Issue 8, Aug. 2011, pp. 2241-2247.
Trees, Harry L. Van, "Detection, Estimation, and Modulation Theory, Optimum Array Processing", in Publication of John Wiley & Sons, Apr. 7, 2004. 3 pages.
Vorobyov, et al., "Robust Adaptive Beamforming Using Worst-Case Performance Optimization: A Solution to the Signal Mismatch Problem", in Journal of IEEE Transactions on Signal Processing, vol. 51, Issue 2, Feb. 2003, pp. 313-324.
Mueller, Thomas J., "Aeroacoustic Measurements", in Publication of Springer Verlag Berlin Heidelberg, 2002. 8 pages.
Dougherty, Robert P., "Extensions of DAMAS and Benefits and Limitations of Deconvolution in Beamforming", in Proceedings of 11th AIAA/CEAS Aeroacoustics Conference, May 23, 2005. 5 pages.
Yardibi, et al., "Sparsity Constrained Deconvolution Approaches for Acoustic Source Mapping", in Journal of Acoustical Society of America, vol. 123, May 2008, pp. 2631-2642.
Ribeiro, et al., "A Fast Transform for Acoustic Imaging with Separable Arrays", in Proceedings of IEEE International Conference on Acoustics, Speech and Signal Processing, May 22, 2011, pp. 2680-2683.
Ribeiro, et al., "Computationally Efficient Regularized Acoustic Imaging", in Proceedings of IEEE International Conference on Acoustics, Speech and Signal Processing, May 22, 2011, pp. 2688-2691.
Horn, et al., "Matrix Analysis", in Publication of Cambridge University Press, Feb. 23, 1990, 18 pages.
Loan, et al., "Approximation with Kronecker Products", in Publication of Kluwer Academic, 1992, pp. 293-314.
Baglama, et al., "Augmented implicitly restarted Lanczos bidiagonalization methods", in SIAM Journal on Scientific Computing, vol. 27, No. 1, Jul. 1, 2005, pp. 1-25.
Drineas, et al., "Fast Monte Carlo algorithms for matrices II: Computing a low-rank approximation to a matrix", in SIAM Journal on Computing, vol. 36, Issue 1, Jul. 27, 2006, pp. 158-183.
Halko, et al., "Finding structure with randomness: Stochastic algorithms for constructing approximate matrix decompositions", in Technical Report No. 2009-05, Sep. 2009, 82 pages.
Pierre, et al., "Experimental performance of calibration and direction-finding algorithms", in Proceedings of International Conference on Acoustics, Speech, and Signal Processing, Apr. 14, 1991, pp. 1365-1368.
Pesavento, et al., "Robust array interpolation using second-order cone programming", in Proceedings of IEEE Signal Processing Letters, vol. 9, Issue 1, Jan. 2002, pp. 8-11.
Li, Chengbo, "An efficient algorithm for total variation regularization with applications to the single pixel camera and compressive sensing", in M.S. thesis, Rice University, Sep. 2009, 90 pages.
Horne, et al., "Measurements of 26%-scale 777 airframe noise in the NASA Ames 40- by 80-foot wind tunnel", in Proceedings of 11th AIAA/CEAS Aeroacoustics Conferen, May 23, 2005, 5 pages.
Humphreys, et al., "Noise spectra and directivity for scalemodel landing gear", in Proceedings of 13th AIAA/CEAS Aeroacoustics Conference, May 21, 2007, 22 pages.
Lee, Sang Soo, "Phased-array measurement of modern regional aircraft turbofan engine noise", in Proceedings of 12th AIAA/CEAS Aeroacoustics Conference, May 8, 2006, 6 pages.

(56) References Cited

OTHER PUBLICATIONS

Oerlemans, et al., "Location and quantification of noise sources on a wind turbine", in the Journal of Sound and Vibration, vol. 299, No. 4-5, Feb. 6, 2007, 38 pages.
Donovan, et al., "Imaging concert hall acoustics using visual and audio cameras", in Proceedings of IEEE International Conference on Acoustics, Speech and Signal Processing, Mar. 31, 2008, pp. 5284-5287.
Wax, et al., "Optimum localization of multiple sources by passive arrays", in Journal of IEEE transactions on acoustics, speech, and signal processing, vol. 31, Issue 5, Oct. 1983, pp. 1210-1217.
Schmidt, R., "Multiple emitter location and signal parameter estimation", in Journal of IEEE Transactions on Antennas and Propagation, vol. 34, Issue 3, Mar. 1986, pp. 276-280.
Roy, et al., "ESPRIT-estimation of signal parameters via rotational invariance techniques", in Journal of IEEE Transactions on Acoustics, Speech, and Signal Processing, vol. 37, Issue 7, Jul. 1989, pp. 984-995.
Zhang et al., "Maximum Likelihood sound source localization and beamforming for directional microphone arrays in distributed meetings", in Journal of IEEE Transactions on Multimedia, vol. 10, Issue 3, Apr. 2008, pp. 538-548.
Brandstein, et al., "A robust method for speech signal time-delay estimation in reverberant rooms", in IEEE International Conference on Acoustics, Speech, and Signal Processing, vol. 1, Apr. 21, 1997, 375-378 pages.
Wang, et al., "Constant-beamwidth and constant-powerwidth wideband robust Capon beamformers for acoustic imaging", in the Journal of the Acoustical Society of America, vol. 116, Issue 3, Sep. 2004, 1621-1631 pages.
Yan, et al., "Optimal array pattern synthesis for broadband arrays", in the Journal of the Acoustical Society of America, vol. 122, Issue 5, Nov. 2007, 2686-2696 pages.
Li, et al., "Beampattern synthesis via a matrix approach for signal power estimation", in Journal of IEEE transactions on signal processing, vol. 55, No. 12, Dec. 2007, 5643-5657 pages.
Wang, et al., "Wideband relax and wideband clean for aeroacoustic imaging", in the Journal of the Acoustical Society of America, vol. 115, No. 2, Feb. 2004, 757-767 pages.
Dougherty, et al., "Sidelobe suppression for phased array aeroacoustic measurements", in Journal of 4th AIAA/CEAS Aeroacoustics Conference, Jun. 1998. 5 pages.
Ehrenfried, et al., "Comparison of iterative deconvolution algorithms for the mapping of acoustic sources", in AIAA Journal, vol. 45, No. 7, Jul. 2007. 3 pages.
Candes, et al., "Stable signal recovery from incomplete and inaccurate measurements", in Journal of Communications on pure and applied mathematics, vol. 59, No. 8, Aug. 2006, pp. 1-15.
Candes, et al., "Robust Uncertainty Principles: Exact Signal Reconstruction from Highly Incomplete Frequency Information", in Journal of IEEE Transactions on Information Theory, vol. 52, Issue 2, Jan. 23, 2006, pp. 1-41.
Donoho, et al., "Compressed sensing", in Journal of IEEE Transactions on information theory, vol. 52, Issue 4, Apr. 2006, pp. 1-34.
Lustig, et al., "Sparse MRI: The application of compressed sensing for rapid MR imaging", in Journal of Magnetic Resonance in Medicine, vol. 58, Issue 6, Oct. 29, 2007, 1182-1195 pages.
Malioutov, et al., "A sparse signal reconstruction perspective for source localization with sensor arrays", in Journal of IEEE Transactions on Signal Processing, vol. 53 Issue 8, Aug. 2005, 3010-3022 pages.
Zimmermann, et al., "FPGA-based real-time acoustic camera prototype", in Proceedings of IEEE International Symposium on Circuits and Systems, May 30, 2010, 4 pages.
Keiner, et al., "Using NFFT 3—a software library for various nonequispaced fast Fourier transforms", in Journal of ACM Transactions on Mathematical Software, vol. 36, Issue 4, Aug. 2009, 30 pages.
Huang, Xun, "Real-time algorithm for acoustic imaging with a microphone array", in Acoustical Society of America, Apr. 9, 2009, 6 pages.
Trees, et al., "Optimum Array Processing: Part IV of Detection, Estimation, and Modulation Theory", in Publication of Wiley, May 10, 2002. 3 pages.
Frigo, et al., "The design and implementation of FFTW 3", in Proceedings of IEEE, vol. 93, Issue 2, Feb. 2005, pp. 216-231.

* cited by examiner

COVARIANCE MATRIX ESTIMATION WITH ACOUSTIC IMAGING

BACKGROUND

When a sensor array is configured to detect and estimate a signal of interest in an environment that also includes sources of noise and interference, a beamformer may be used to increase the signal-to-noise ratio of the signal of interest, thus improving its detection and estimation. The term "beamformer" refers here to a software program executable by a processor of a computing device, or to an ASIC, FPGA, or other hardware implementation of the logic of such a program, which filters and combines the signals received by a sensor array. The beamformer is designed so that a signal of interest arriving from a prescribed direction is preserved but the noise and interference arriving from other directions are suppressed. For example, a beamformer may be used to isolate the sound of one instrument in an orchestra.

The most common methods for beamformer design rely on statistical models using covariance matrices. Beamformer design assumes knowledge of the covariance matrix of the noise and interference (called $S_n$ below) for each frequency band of interest. This covariance matrix provides a description of the undesired signals impinging on the array, which may be cancelled or suppressed to improve the signal-to-noise ratio of the processed signal.

Algorithms to estimate $S_n$ often include determining when the source of interest is not active (for example, when a speaker is not talking); this determination may then be used to gate the update of $S_n$. Unfortunately, this gating is imperfect and can have incorrect timing even under moderate signal-to-noise ratio conditions. Furthermore, in some applications the source of interest may be continuously active (for example, a piano during a concert), such that no gating mechanism exists. A beamformer generated under these conditions may have a sample covariance estimate of $S_n$ that includes the signal of interest. Thus, the beamformer may treat the signal of interest as noise and attempt to cancel it. Techniques developed to avoid this signal cancellation effect generally have side-effects, such as loss of optimality of the designed beamformer.

SUMMARY

According to one embodiment of the present disclosure, a computing device is provided, comprising a processor configured to receive from a microphone array a set of measurements of a vector x of acoustic data, including noise, interference, and a signal of interest. The processor may be further configured to apply a transform to the measurements so that x is expressed in a frequency domain, wherein the frequency is discretized in a plurality of intervals. For each interval, the processor may be configured to generate an estimate $\hat{S}_x$ of a covariance matrix of x. For each covariance matrix estimate $\hat{S}_x$, the processor may be further configured to use acoustic imaging to obtain an estimate $\hat{Y}$ of a spatial source distribution. For each spatial source distribution estimate $\hat{Y}$, the processor may be further configured to remove the signal of interest to produce an estimate $\hat{W}$ of a noise and interference spatial source distribution. For each noise and interference spatial source distribution estimate $\hat{W}$, the processor may be further configured to generate an estimate $\hat{S}_n$ of a noise and interference covariance matrix. The processor may generate a beamformer configured to remove the noise and interference from the acoustic data, wherein the noise and interference at each frequency are identified using the noise and interference covariance matrix estimate $\hat{S}_n$ for that frequency.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The inventor of the subject application has studied approaches by researchers who have responded to the above problems in beamformer design by developing techniques that aim to reduce the sensitivity of the estimate of $S_n$ to contamination by the signal of interest. However, the inventor of the subject application has recognized that these techniques tend to suffer from two problems. First, they rely on parameters which may be difficult to estimate for real-world scenarios. Second, even when those parameters are estimated accurately, the gain in robustness may come at a price of a decreased signal-to-noise ratio.

As a solution to the problems with these existing methods of beamformer generation mentioned above, a computing device configured to generate a beamformer is disclosed. Generating the beamformer includes estimating $S_n$ based on a spatial distribution of one or more sources of noise and/or interference in the environment surrounding a microphone array. This distribution of one or more sources of noise and/or interference is estimated using acoustic imaging, as described in detail below.

Figure 1:
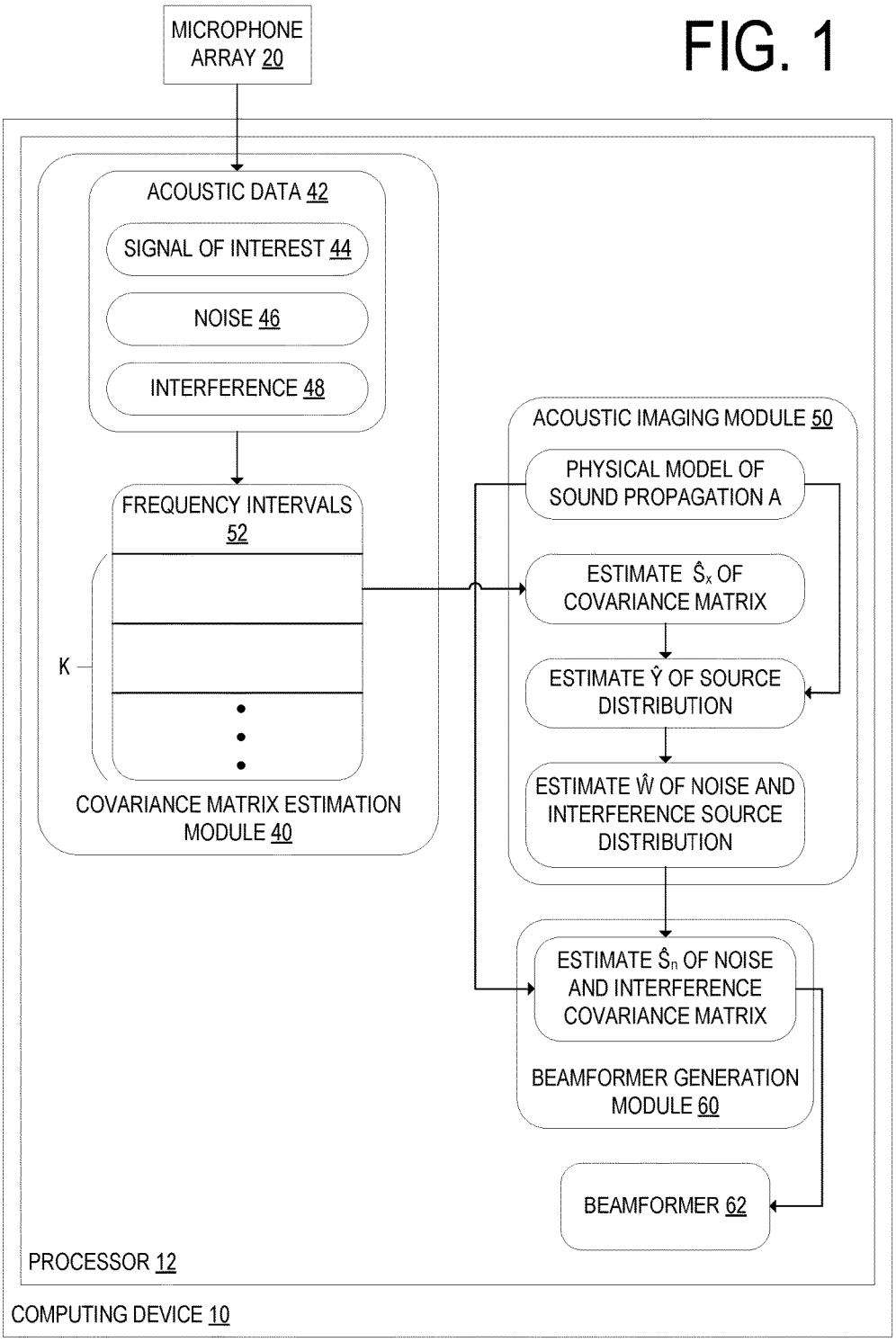
FIG. 1 shows an example computing device comprising a processor configured to receive a set of acoustic data from a microphone array and generate a beamformer, according to one embodiment of the present disclosure.

FIG. 1 depicts an example computing device 10 comprising a processor 12. The processor 12 is configured to receive a set of acoustic data 42 from a microphone array 20. This acoustic data may comprise time-domain samples from the microphones of the microphone array 20, obtained at a known sampling rate and with synchronous sampling across microphones. The acoustic data 42 includes noise 46, interference 48, and a signal of interest 44.

Let N be the number of microphones in the microphone array 20, and $x(n)\in\mathbb{R}^N$ be its acoustic data 42 represented as time-domain samples, where n is the time index. The microphone array 20 may input the acoustic data 42 into a covariance matrix estimation module 40. The covariance matrix estimation module 40 may apply a transform to x(n) so that the acoustic data 42 is expressed in a frequency domain. The transform applied to the acoustic data 42 may be a fast Fourier transform. Let $x(\omega)$ denote a frequency domain representation of the acoustic data 42, where $\omega$ is the frequency. When discrete-time acoustic data 42 is expressed in the frequency domain, the frequency range of the microphone array 20 is discretized in a plurality K of intervals 52, also called frequency bands. Each frequency band 52 is defined by a predetermined bandwidth $B_k$ and center frequency $\omega_k$ with $1\leq k\leq K$, which are determined by the transform. Frequency bands are assumed to be narrow enough (have sufficiently small $B_k$) such that changes in the envelope of the incident signals appear simultaneously over elements of the array.

By definition, the covariance matrix of a zero-mean random vector x is given by $S_x=E\{xx^H\}$, where $E\{\cdot\}$ denotes mathematical expectation and $\cdot^H$ denotes Hermitian transpose. For each frequency band 52 with center frequency $\omega_k$, the covariance matrix estimation module 40 is configured to generate an estimate of $S_x(\omega_k)=E\{x(\omega_k)x^H(\omega_k)\}$, the covariance matrix of $x(\omega)$. Note the covariance matrix $S_x(\omega_k)$ models all the acoustic data 42 for the band centered at $\omega_k$, including signal of interest 44, noise 46, and interference 48.

An estimate $\hat{S}_x(\omega_k)$ of the ideal $S_x(\omega_k)$ may be determined by the covariance matrix estimation module 40 by computing $$\hat{S}_x(\omega_k)=\frac{1}{L}\sum_{l=1}^{L}x_l(\omega_k)x_l^H(\omega_k),$$

where $x_l(\omega_k)$ for $1\leq l\leq L$ are frequency-domain snapshots obtained by transforming L blocks of time-domain acoustic data 42 into the frequency domain. When this formula is used, each $x_l(\omega_k)$ may be obtained using a fast Fourier transform (FFT).

Figure 2:
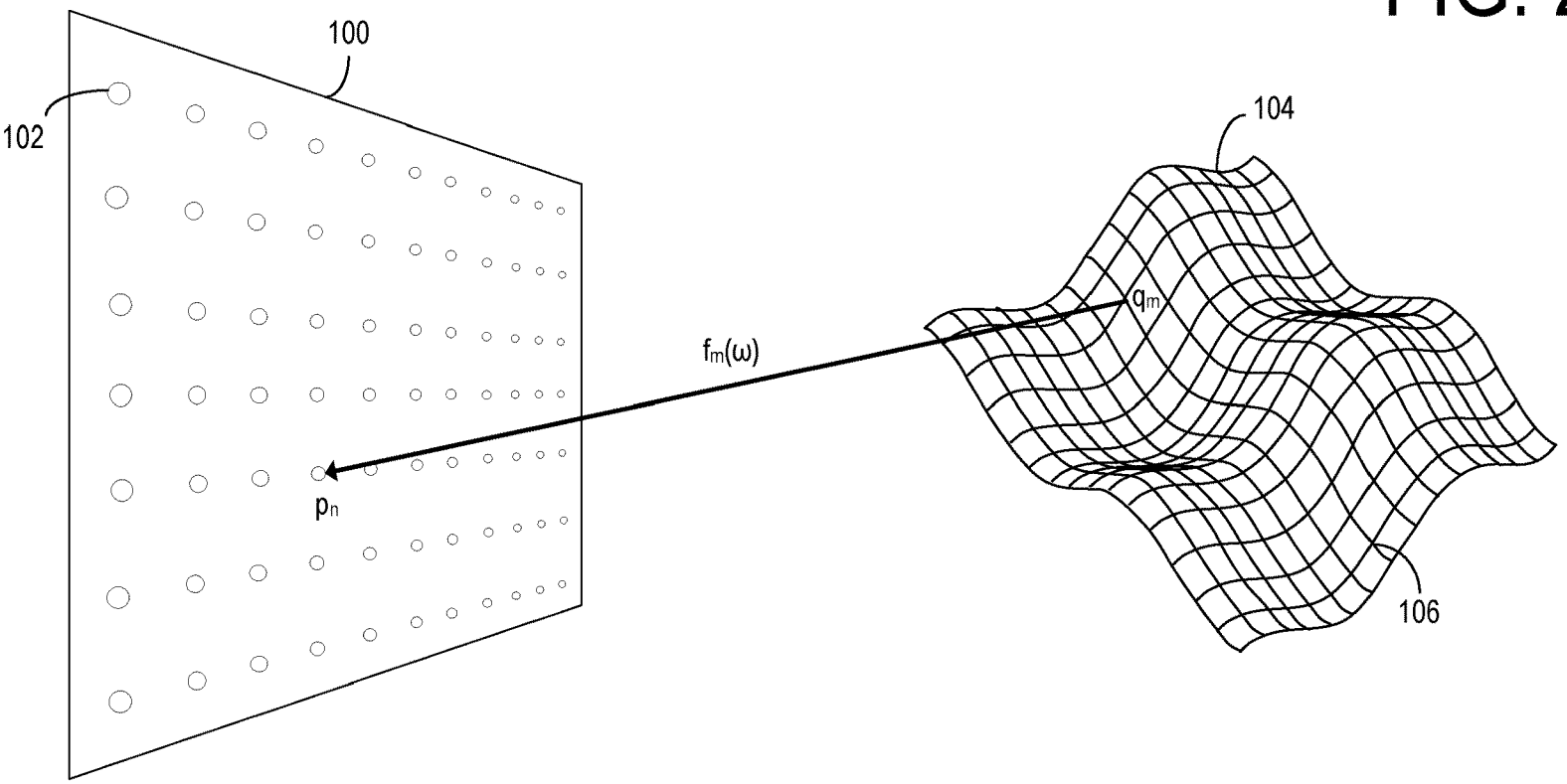
FIG. 2 shows an example microphone array configured to detect acoustic data, according to one embodiment of the present disclosure.

The mathematical theory used in acoustic imaging is presented next. FIG. 2 shows an example microphone array 100 configured to detect sound waves emitted by an example acoustic source distribution 104 defined over a parameterized surface in 3D space. It is assumed that all sound sources are located over this surface with good approximation. The microphone array 100 includes N microphones 102. The source distribution 104 is discretized into M point sources 106. Each microphone 102 has the spatial coordinates $p_n\in\mathbb{R}^3$, and each point 106 has the spatial coordinates $q_m\in\mathbb{R}^3$. The source signal emitted at $q_m$ is denoted $f_m(\omega_k)$.

For each point 106 in the source distribution 104, an array manifold vector (also called steering vector in the literature) is denoted $v(q_m,\omega_k)\in\mathbb{C}^N$. The manifold vector models the amplitude and phase response of the array to a point source at location $q_m$, radiating a signal with frequency $\omega_k$. By definition, $v(q_m,\omega_k)$ includes the attenuation and propagation delay due to the distance between $q_m$ and each of the N array elements. It may also model other effects such as microphone directivities. Define the array manifold matrix as $$V(\omega_k)=[v(q_1,\omega_k)v(q_2,\omega_k)\ \ldots\ v(q_M,\omega_k)].$$

The frequency domain signal produced by the M sources is further denoted as $$f(\omega_k)=[f_1(\omega_k)f_2(\omega_k)\ \ldots\ f_M(\omega_k)]^T.$$

The signal $x(\omega_k)\in\mathbb{C}^N$ measured by all array microphones is modeled as $$x(\omega_k)=V(\omega_k)f(\omega_k)+\eta(\omega_k),$$

where $\eta(\omega_k)\in\mathbb{C}^N$ represents spatially uncorrelated noise. Note this model describes the signal $x(\omega_k)$ as a linear superposition of the signals emitted by the sources at $q_1,\ldots,q_M$, with their respective propagation delays and attenuation modeled by $V(\omega_k)$.

Recall the covariance matrix of $x(\omega_k)$ is defined as $$S_x(\omega_k)=E\{x(\omega_k)x^H(\omega_k)\},$$

where E is the expectation operator. Expanding the vector $x(\omega_k)$ gives $$S_x(\omega_k)=V(\omega_k)E\{f(\omega_k)f^H(\omega_k)\}V^H(\omega_k)+\sigma^2(\omega_k)I,$$

where $\sigma^2(\omega_k)$ is the variance of the noise and I is an identity matrix. In order to make solving for all M acoustic source intensities computationally tractable, $E\{f(\omega_k)f^H(\omega_k)\}$ is assumed to be a diagonal matrix. This is an assumption that different points 106 in the source distribution 104 radiate uncorrelated signals. This assumption may be an approximation, for example, for points that are located on the same object, but it reduces the number of unknowns from $M^2$ to M when estimating the acoustic image.

Under the assumption that $E\{f(\omega_k)f^H(\omega_k)\}$ is diagonal, the covariance matrix $S_x(\omega_k)$ may be written $$S_x(\omega_k)=\Sigma_{m=1}^{M}E\{|f_m(\omega_k)|^2\}v(q_m,\omega_k)v^H(q_m,\omega_k)+\sigma^2I.$$

Define vec{X} as the vectorization operator, which converts any arbitrary matrix X into a column vector by stacking its columns. The source distribution 104 may be represented by a matrix $Y(\omega_k)\in\mathbb{R}^{M_x\times M_y}$, where $$M=M_xM_y$$

and $$\mathrm{diag}\{E\{f(\omega_k)f^H(\omega_k)\}\}=\mathrm{vec}\{Y(\omega_k)\}.$$

This matrix $Y(\omega_k)$ is called an acoustic image, and contains a 2-D representation of the power radiated by the M acoustic sources 106 in the source distribution 104. In effect, each point in the image indicates the acoustic power radiated by a point source at a given location in space. As will be explained, the above equation can be used to solve for an estimate of $Y(\omega_k)$ given an estimate $\hat{S}_x(\omega_k)$ of $S_x(\omega_k)$.

The acoustic imaging module 50 uses a physical model of sound propagation $A(\omega_k)$ to obtain an estimate $\hat{Y}(\omega_k)$ of the source distribution. $A(\omega_k)$ models the physics of wave propagation from a collection of discrete acoustic sources at coordinates $\{q_m\}_{m=1}^{M}$ to every sensor $p_n$ in the microphone array 20. In this formulation, $A(\omega_k)$ is defined as a transform that given an acoustic source distribution $Y(\omega_k)$, produces a corresponding ideal (noiseless) covariance matrix $S_x(\omega_k)$ that would be measured by the microphone array 20.

One possible expression for $A(\omega_k)$ emerges naturally by manipulating the expression for $S_x(\omega_k)$ above. To see this, first define $\otimes$ as the Kronecker product. Then it can be shown by algebraic manipulation that the previous equation for $S_x(\omega_k)$ is equivalent to $$\mathrm{vec}\{S_x(\omega_k)\}=A(\omega_k)\mathrm{vec}\{Y(\omega_k)\}+\sigma^2\mathrm{vec}\{I\},$$

with $$A(\omega_k)=[v^*(q_1)\otimes v(q_1)v^*(q_2)\otimes v(q_2)\ \ldots\ v^*(q_M)\otimes v(q_M)].$$

Existing acoustic imaging estimation techniques typically rely on delay-and-sum beamforming, in which an estimate $\hat{Y}(\omega_k)$ of the source distribution is obtained from $\hat{S}_x(\omega_k)$ using the following equation:

$$\hat{Y}_m(\omega_k) \approx \frac{v^H(q_m, \omega_k)\hat{s}_x(\omega_k)v(q_m, \omega_k)}{[v^H(q_m, \omega_k)v(q_m, \omega_k)]^2}.$$

However, even in the absence of noise or interference, this estimate of the source distribution may not be accurate. When a beamformer uses the above equation to produce an estimate of the source distribution, sidelobes are produced in addition to a main lobe. Due to the formation of sidelobes, delay-and-sum beamforming overestimates the source distribution and produces estimates of $\hat{Y}_m(\omega_k)$ with low resolution.

In place of beamforming, more accurate imaging techniques may be used instead. One class of methods involve directly solving $\mathrm{vec}\{\hat{S}_x(\omega_k)\}=A(\omega_k)\mathrm{vec}\{\hat{Y}(\omega_k)\}$ for $\hat{Y}(\omega_k)$ using a least-squares method. Note that $M \gg N$ in many practical cases, such that this equation may be substantially underdetermined. As described below, the formulations for solving it may include L1 regularized least squares, total-variation regularized least-squares and Gauss-Seidel implementations such as a deconvolution approach for the mapping of acoustic sources (DAMAS).

Let $\hat{y}(\omega_k)=\mathrm{vec}\{\hat{Y}(\omega_k)\}$ be the vectorization of the estimated source distribution $\hat{Y}(\omega_k)$ and $\hat{s}(\omega_k)=\mathrm{vec}\{\hat{S}_x(\omega_k)\}$ be the vectorization of the estimated covariance matrix $\hat{S}_x(\omega_k)$. In some implementations, the acoustic imaging module 50 may solve for the image $\hat{y}(\omega_k)$ that minimizes $\|\Psi\hat{y}(\omega_k)\|$ subject to the constraint $A(\omega_k)\hat{y}(\omega_k)=\hat{s}(\omega_k)$, where $\Psi$ is a sparsifying transform. If $\Psi$ is the identity transform and $\|\cdot\|$ is the 1-norm, one obtains a basis pursuit (BP) formulation of the minimization problem above. Alternatively, if $\Psi$ is a 2D first difference operator and $\|\cdot\|$ is the 2-norm, one obtains an isotropic total-variation (TVL2) minimization formulation.

The acoustic imaging module 50 may also use basis pursuit denoising (BPDN) to obtain an estimate $\hat{Y}(\omega_k)$ of the source distribution. When BPDN is used, the acoustic imaging module 50 is configured to determine a value of $\hat{y}(\omega_k)$ that minimizes $\|\hat{y}(\omega_k)\|_1$ subject to the constraint $\|\hat{s}(\omega_k)-A(\omega_k)\hat{y}(\omega_k)\|_2\leq\sigma$, where $\sigma$ is the standard deviation of the spatially uncorrelated noise as defined above. Alternately, the acoustic imaging module 50 may be configured to determine a value of $\hat{y}(\omega_k)$ that minimizes $\|\hat{y}(\omega_k)\|_{TV}+\mu\|s(\omega_k)-A(\omega_k)y(\omega_k)\|_2^2$ for some constant $\mu$, where $\|\cdot\|_{TV}$ is a total variation norm. Alternately, a deconvolution approach for the mapping of acoustic sources (DAMAS) may be used to obtain $\hat{y}(\omega_k)$ that minimizes $\|s(\omega_k)-A(\omega_k)\hat{y}(\omega_k)\|_2^2$ directly using Gauss-Seidel iterations, where non-negativity is enforced for the elements of $\hat{y}(\omega_k)$.

Estimating $\hat{Y}(\omega_k)$ from $\hat{S}_x(\omega_k)$ with these methods may be computationally very expensive, especially if M or N are large. To produce an estimate of $\hat{Y}(\omega_k)$ more quickly, the propagation transform $A(\omega_k)$ may be implemented with a fast array transform. If required by numerical methods, the adjoint $A^H(\omega_k)$ may also be implemented with a fast array transform. "Fast transform" is a term of art that refers to a numerically stable algorithm which accelerates the computation of a mathematical function (i.e., has lower computational complexity), generally by orders of magnitude. The computational complexity of a transform may be reduced by making mathematical approximations or using mathematically exact simplifications such as matrix factorizations. The fast array transform may be selected from the group consisting of a Kronecker array transform (KAT), a fast non-equispaced Fourier transform (NFFT), and a fast non-equispaced in time and frequency Fourier transform (NNFFT).

Returning to FIG. 1, once the covariance matrix estimation module 40 has produced an estimate $\hat{S}_x(\omega_k)$ of the covariance matrix $S_x(\omega_k)$, the estimate is passed to an acoustic imaging module 50. For each covariance matrix estimate $\hat{S}_x(\omega_k)$, the acoustic imaging module 50 is configured to use acoustic imaging to obtain $\hat{Y}(\omega_k)$, an estimate of the source distribution $Y(\omega_k)$. The estimate of the source distribution includes an estimate of a location and an acoustic power for each source located in a region of interest within line of sight of the microphone array 20. The sources included in the estimate of the source distribution $\hat{Y}(\omega_k)$ include the signal of interest 44, noise 46, and interference 48.

Once the acoustic imaging module 50 has generated an estimate $\hat{Y}(\omega_k)$ of the source distribution for each frequency interval 52, then for each image $\hat{Y}(\omega_k)$, the acoustic imaging module 50 is configured to remove the signal of interest 44 to produce an estimate $\hat{W}(\omega_k)$ of a noise and interference source distribution $W(\omega_k)$. The acoustic imaging module 50 may remove the signal of interest 44 from the source distribution estimate $\hat{Y}(\omega_k)$ using models and/or heuristics specific to an application in which the invention is used. For example, face detection may be used to associate sound sources with faces. In this example, the signal of interest 44 may be assumed to be a highest-power connected component of the acoustic data 42 that comes from an area of the source distribution estimate $\hat{Y}(\omega_k)$ located over a face. The processor 12 may be configured to remove the signal of interest 44 from each source distribution estimate $\hat{Y}(\omega_k)$ using image segmentation. As another example, watershed segmentation may be used to find all connected components in $\hat{Y}(\omega_k)$. The signal of interest 44 may be assumed to be a highest-power connected component which has a non-stationary power and a spectrum consistent with speech, for example, dominant spectral content below 4 kHz.

For each noise and interference source distribution estimate $\hat{W}(\omega_k)$, the processor 12 is configured to generate an estimate $\hat{S}_n(\omega_k)$ of a noise and interference covariance matrix $S_n(\omega_k)$ from $\hat{W}(\omega_k)$. The noise and interference covariance matrix estimate $\hat{S}_n(\omega_k)$ simulates the covariance matrix $S_x(\omega_k)$ that would be measured by the microphone array 20 in the presence of noise 46 and interference 48 distributed according to the noise and interference source distribution $\hat{W}(\omega_k)$, in the absence of the signal of interest 44. Since the source of interest is explicitly removed from the image of noise and interference $\hat{W}(\omega_k)$, its statistics are guaranteed not to be modeled in $\hat{S}_n(\omega_k)$, thus avoiding the signal of interest contamination problem described previously.

If a physical model of sound propagation $A(\omega_k)$ is used when obtaining the source distribution estimate $\hat{Y}(\omega_k)$, the noise and interference covariance matrix estimate $\hat{S}_n(\omega_k)$ may be determined using the formula $$\mathrm{vec}\{\hat{S}_n(\omega_k)\}=A(\omega_k)\mathrm{vec}\{W(\omega_k)\}.$$

As before, $A(\omega_k)$ may be implemented as a fast array transform. The acoustic imaging module 50 may then convey the noise and interference covariance matrix estimate $\hat{S}_n(\omega_k)$ to a beamformer generation module 60. The use of a fast array transform can significantly reduce the computational requirements for synthesizing covariance matrices from acoustic images.

At the beamformer generation module 60, the processor 12 is configured to generate a beamformer 62 that can be used to remove the noise 46 and interference 48 from the acoustic data 42. When the beamformer generation module 60 generates the beamformer 62, it uses the noise and interference covariance matrix estimate $\hat{S}_n(\omega_k)$ for each frequency interval 52. The noise 46 and interference 48 at each frequency interval 52 are identified using the noise and interference covariance matrix estimate $\hat{S}_n(\omega_k)$ for that frequency.

The beamformer 62 generated by the beamformer generation module 60 may be a minimum variance directional response (MVDR) beamformer. In an MVDR beamformer, a weight vector for each frequency is given by $$W_{MVDR}^{H}(\omega_k) = \frac{v^H(q, \omega_k)s_n^{-1}(\omega_k)}{v^H(q, \omega_k)s_n^{-1}(\omega_k)v(q, \omega_k)},$$

where q represents a point in space where the beamformer 62 has unity gain (referred to as a "look direction" in the literature). For each frequency interval 52, the beamformer 62 is configured to multiply the measured signal $x(\omega_k)$ by the weight vector $w_{MVDR}^{H}(\omega_k)$, producing the scalar output $w_{MVDR}^{H}(\omega_k)x(\omega_k)$. This multiplication may allow the beamformer 62 to remove noise 46 and interference 48 from the acoustic data 42.

Figure 3:
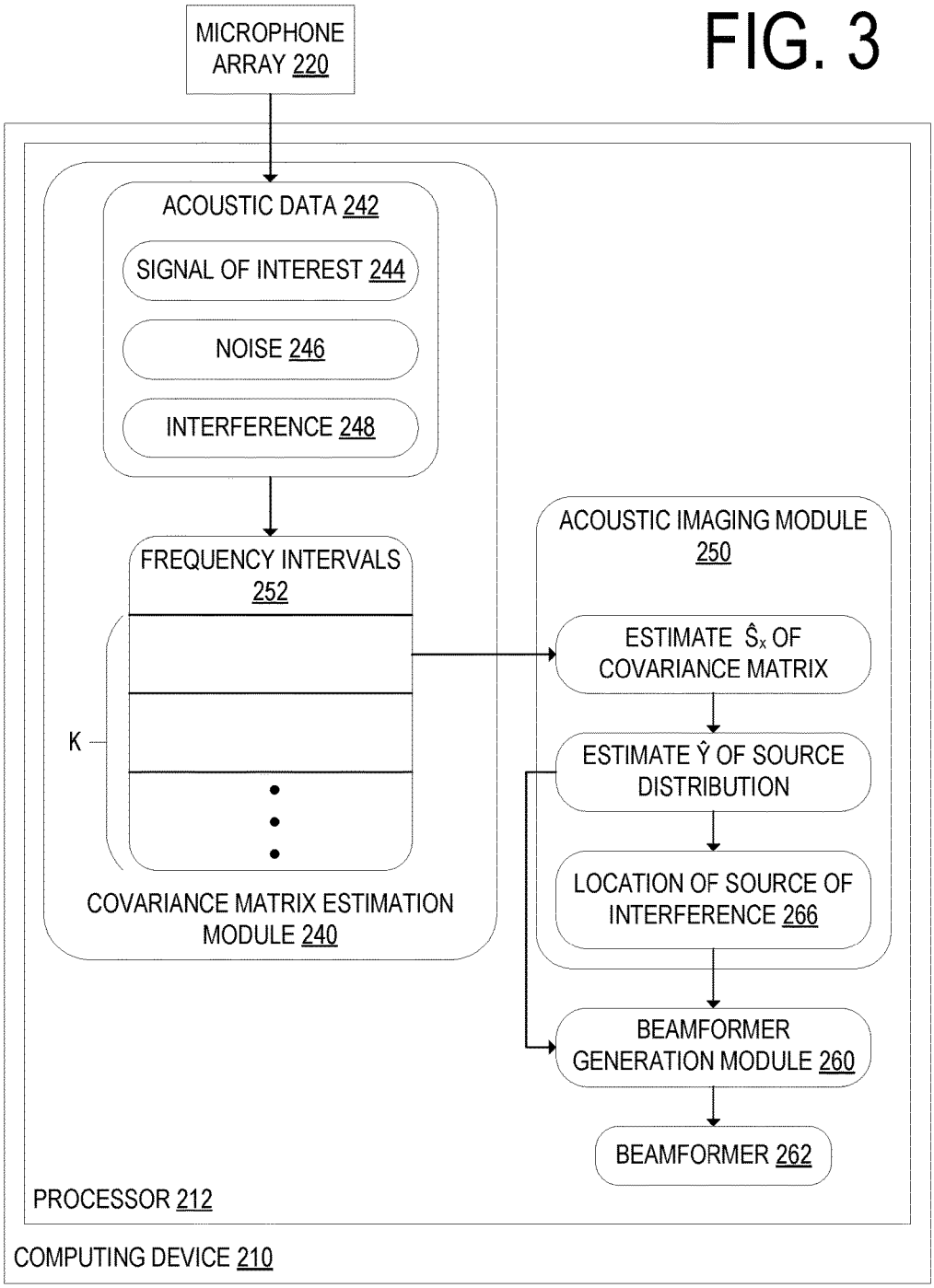
FIG. 3 shows another example computing device comprising a processor configured to receive a set of acoustic data from a microphone array and generate a beamformer, according to a second embodiment of the present disclosure.

Another example embodiment of the present disclosure is depicted in FIG. 3. FIG. 3 shows a computing device 210, comprising a processor 212 configured to receive a set of acoustic data 242 from a microphone array 220. The acoustic data 242 includes noise 246, interference 248, and a signal of interest 244. The acoustic data 242 is sent to a covariance matrix estimation module 240, which is configured to apply a transform to the acoustic data 242 so that the acoustic data 242 is expressed in a frequency domain. The transform applied to the acoustic data 242 may be an FFT. The frequency of the acoustic data 242 is discretized in a plurality K of intervals 252. For each interval 252, the covariance matrix estimation module 240 is configured to generate an estimate $\hat{S}_x(\omega_k)$ of a covariance matrix $S_x(\omega_k)$. These estimates may be generated using the techniques disclosed in the description of FIG. 1.

The covariance matrix estimate $\hat{S}_x(\omega_k)$ may be sent to an acoustic imaging module 250. For each covariance matrix estimate $\hat{S}_x(\omega_k)$, the acoustic imaging module 250 is configured to use acoustic imaging to obtain a source distribution estimate $\hat{Y}(\omega_k)$. The image $\hat{Y}(\omega_k)$ is processed to determine the location of a source of interest and the location of one or more sources of interference 266.

The processor 12 may then convey the estimate of the signal of interest and the location of the one or more sources of interference 266 to a beamformer generation module 260. The beamformer generation module 260 is configured to generate a beamformer 262 with a unity gain response toward the signal of interest 244 and a spatial null toward each source of interference 248. The beamformer 268 may be a deterministic beamformer, for example, a least-squares beamformer or a deterministic maximum likelihood beamformer.

Figure 4:
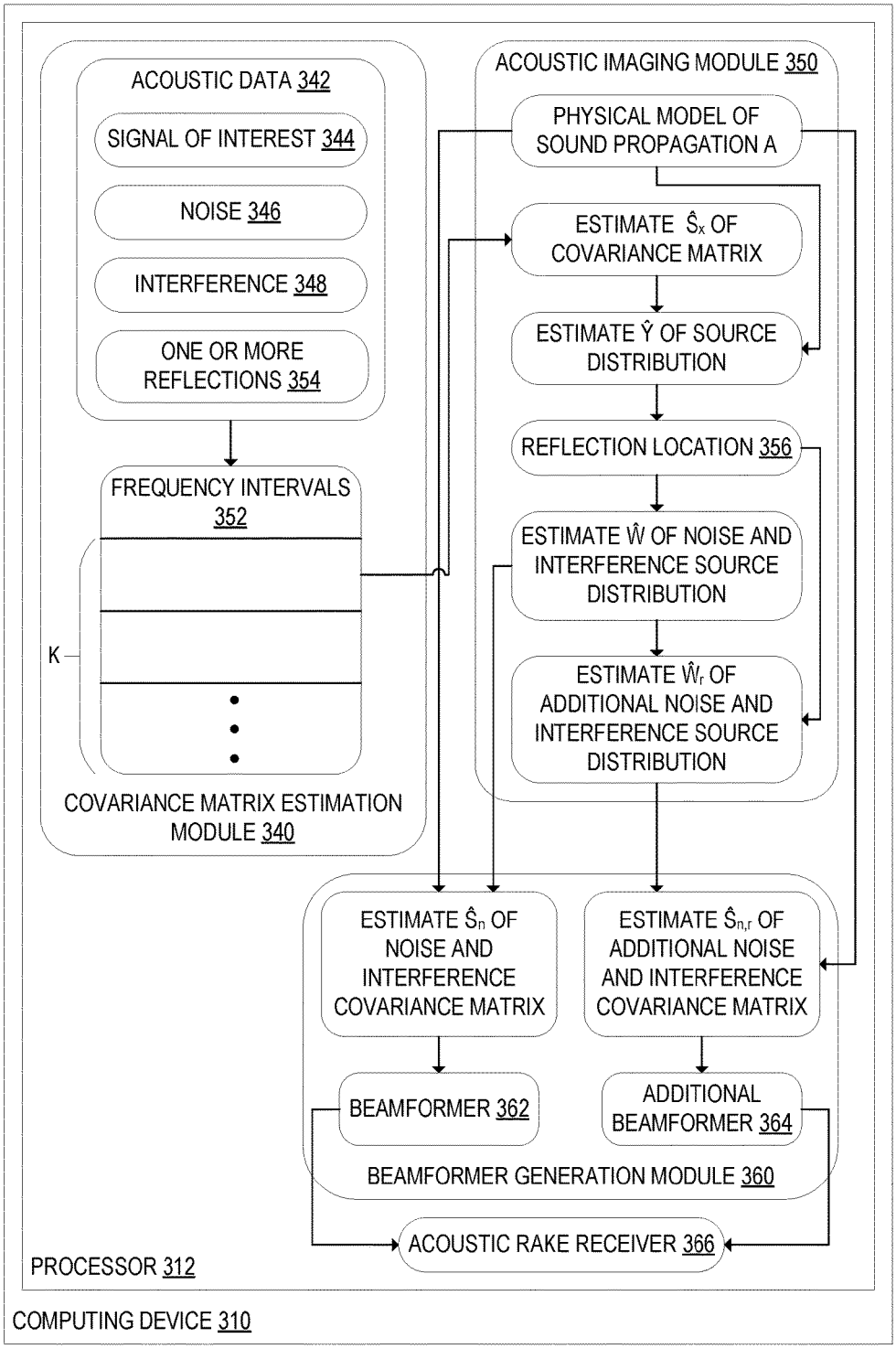
FIG. 4 shows an example computing device comprising a processor configured to receive a set of acoustic data from a microphone array and generate an acoustic rake receiver, according to a third embodiment of the present disclosure.

Another example embodiment of the present disclosure is depicted in FIG. 4. FIG. 4 shows a computing device 310, comprising a processor 312 configured to receive a set of acoustic data 342 from a microphone array 320. The acoustic data 342 includes noise 346, interference 348, a signal of interest 344, and one or more reflections 354 of the signal of interest 344. The acoustic data 342 is sent to a covariance matrix estimation module 340, which is configured to apply a transform to the acoustic data 342 so that the acoustic data 342 is expressed in a frequency domain. The transform applied to the acoustic data 342 may be an FFT. The frequency of the acoustic data 342 is discretized in a plurality of intervals 352, wherein each interval 352 has a predetermined size $B_k$ and center frequency $\omega_k$ with $1 \le k \le K$. For each interval 352, the covariance matrix estimation module is configured to generate a covariance matrix estimate $\hat{S}_x(\omega_k)$. These estimates may be generated using the techniques disclosed in the description of FIG. 1.

The covariance matrix estimate $\hat{S}_x(\omega_k)$ may be sent to an acoustic imaging module 350. For each covariance matrix estimate $\hat{S}_x(\omega_k)$, the acoustic imaging module 350 is configured to use acoustic imaging to obtain a source distribution estimate $\hat{Y}(\omega_k)$. The acoustic imaging module 350 uses a physical model of sound propagation $A(\omega_k)$ in the determination of the source distribution estimate $\hat{Y}(\omega_k)$. In addition, the acoustic imaging module 350 is configured to determine locations 356 of the one or more reflections 354 of the signal of interest 344 in the source distribution $\hat{Y}(\omega_k)$.

For each image $\hat{Y}(\omega_k)$, the acoustic imaging module 350 may remove the signal of interest 344 to produce an image $\hat{W}(\omega_k)$. In parallel, the acoustic imaging module 350 may individually remove each of the one or more reflections 354 from $\hat{Y}(\omega_k)$ to produce R additional noise and interference source distribution estimates $\hat{W}_r(\omega_k)$, for $1 \le r \le R$. Each of the reflections 354 may be removed from the noise and interference source distribution estimate $\hat{Y}(\omega_k)$ using the same techniques by which the signal of interest 344 is removed from the source distribution estimate $\hat{Y}(\omega_k)$ to produce $\hat{W}(\omega_k)$.

For each $\hat{W}(\omega_k)$ and each $\hat{W}_r(\omega_k)$ with $1 \le r \le R$, the acoustic imaging module 350 may generate corresponding covariance matrix estimates $\hat{S}_n(\omega_k)$ and $\hat{S}_{n,r}(\omega_k)$, for $1 \le r \le R$. The acoustic imaging module 350 may generate them using the physical model of sound propagation $A(\omega_k)$, such that $\hat{S}_n(\omega_k)=A(\omega_k)\hat{W}(\omega_k)$ and $\hat{S}_{n,1}(\omega_k)=A(\omega_k)\hat{W}_1(\omega_k), \ldots, \hat{S}_{n,R}(\omega_k)=A(\omega_k)\hat{W}_R(\omega_k)$. As before, $A(\omega_k)$ may be implemented as a fast array transform. The acoustic imaging module 350 may then convey these covariance matrices to a beamformer generation module 360.

For each generated covariance matrix, the beamformer generation module 360 is configured to generate a beamformer. Beamformer 362 is generated to enhance the signal of interest 344 and reject signals represented in $\hat{S}_n(\omega_k)$, which include noise 346, interference 348, and all reflections 354. Informally, one may say beamformer 362 is steered towards the signal of interest 344. Each of the R additional beamformers 364 is generated to enhance a specific reflection and reject the signals represented in its corresponding $\hat{S}_{n,r}(\omega_k)$, for $1 \le r \le R$, which include noise 346, interference 348, the signal of interest 344, and other reflections 354. Likewise, one may say each beamformer 364 is steered towards its corresponding reflection 354. The beamformers 362 and 364 may be, for example, MVDR beamformers.

The beamformer generation module 360 is further configured to generate an acoustic rake receiver 366 using the beamformer 362 of the signal of interest 344 and the additional beamformer 364 of each reflection 354. The acoustic rake receiver 366 is configured to combine the signal of interest 344 with the one or more reflections 354.

A phase shift relative to the signal of interest 344 is applied to each reflection 354 so constructive interference is achieved, and the energy of a sum of the signal of interest 344 and each reflection 354 is maximized. The acoustic rake receiver 366 may thus increase a signal-to-noise ratio of the signal of interest 344.

Figure 5:
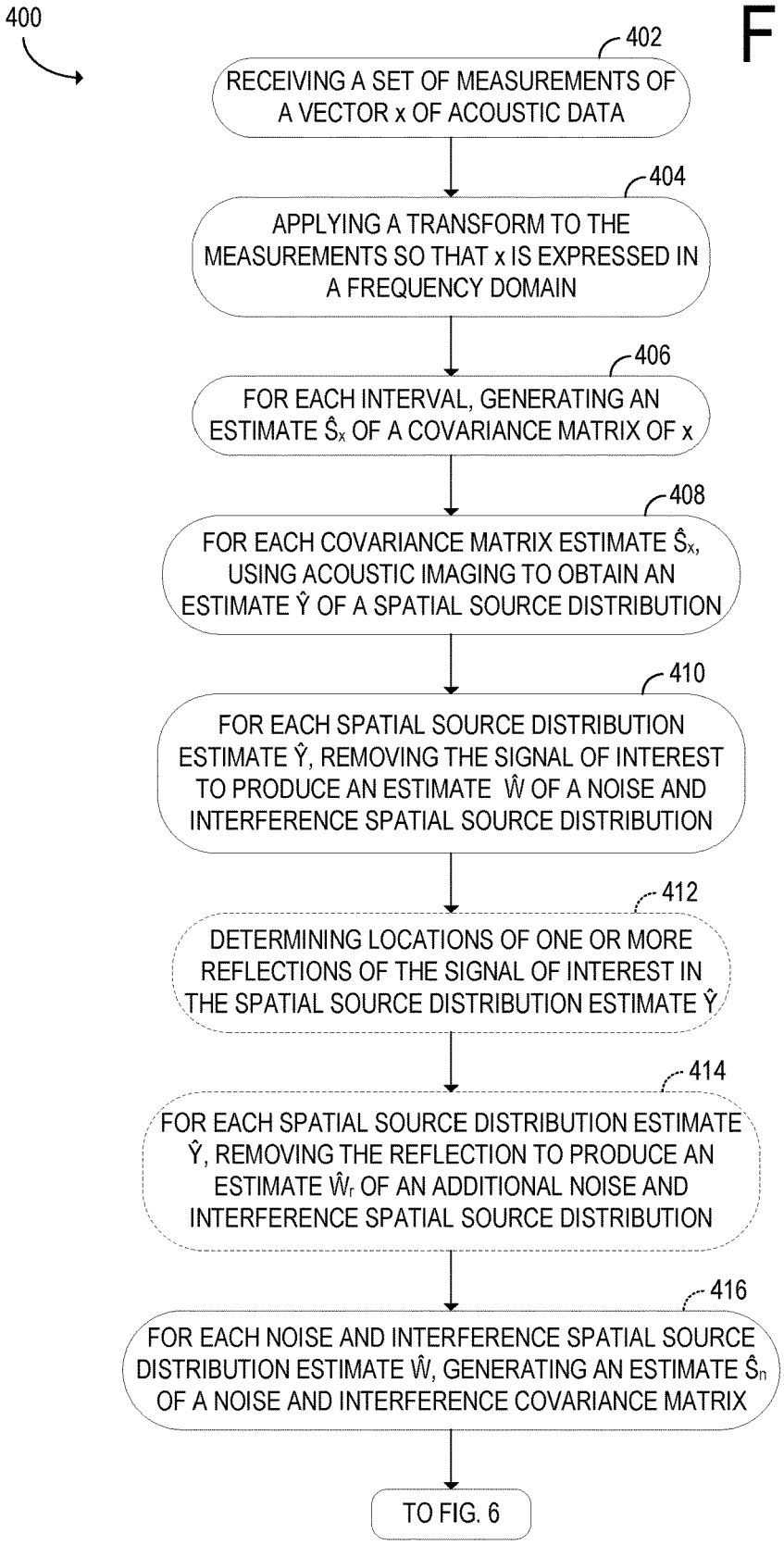
FIG. 5 is a flowchart of an example beamformer generation method for use with a computing device, according to one embodiment of the present disclosure.
Figure 6:
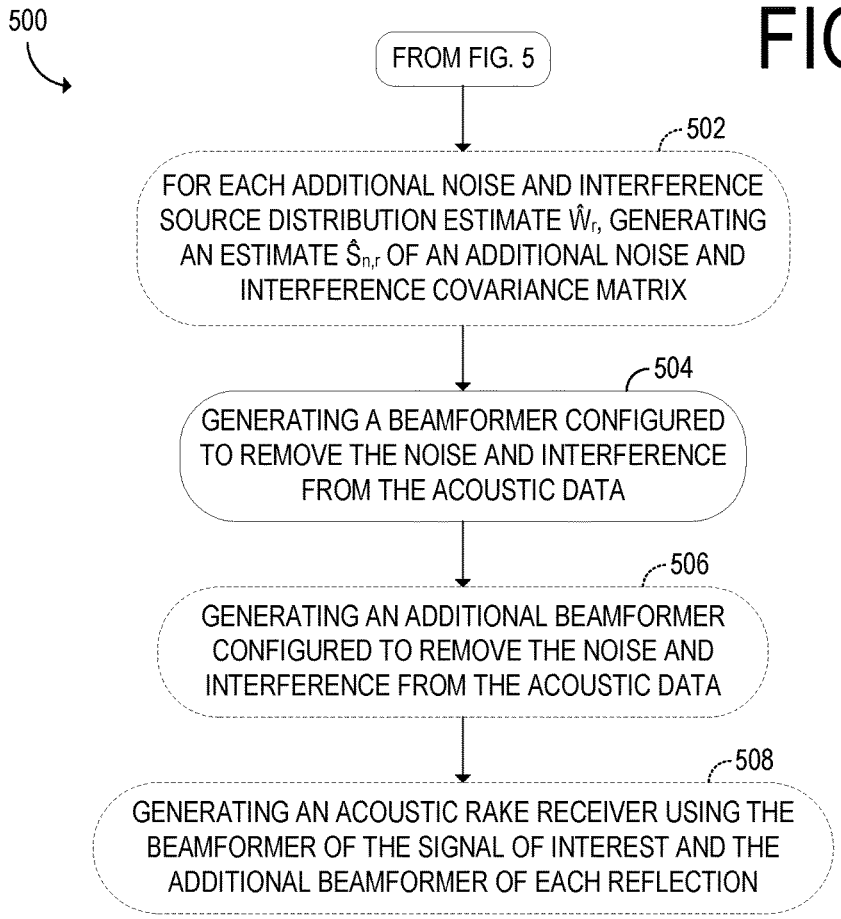
FIG. 6 is a flowchart that continues the method of FIG. 5, according to one embodiment of the present disclosure.

FIGS. 5 and 6 depict a flowchart of a method 400 for use with a computing device. At step 402, the method includes receiving from a microphone array a set of measurements of a vector x of acoustic data, including noise, interference, and a signal of interest. The acoustic data may also include at least one reflection of the signal of interest. At step 404, the method includes applying a transform to the measurements so that x is expressed in a frequency domain. The transform applied to the acoustic data may be a fast Fourier transform, or may be some other transform. The transform discretizes the frequency in a plurality K of intervals.

At step 406, the method includes generating an estimate $\hat{S}_x(\omega_k)$ of a covariance matrix of x for each interval, for example using the algorithms in the description of FIG. 1 above. At step 408, the method includes using acoustic imaging to obtain an estimate $\hat{Y}(\omega_k)$ of a spatial source distribution for each covariance matrix $\hat{S}_x(\omega_k)$. Acoustic imaging may also be performed as in the description of FIG. 1. The use of acoustic imaging may include a fast array transform.

At step 410, the method may further include removing the signal of interest from $\hat{Y}(\omega_k)$ to produce an estimate $\hat{W}(\omega_k)$ of a noise and interference spatial source distribution. The signal of interest may be removed from each spatial source distribution estimate $\hat{Y}(\omega_k)$ using image segmentation or some similar technique.

Some embodiments may include step 412, at which locations of one or more reflections of the signal of interest in the spatial source distribution estimate $\hat{Y}(\omega_k)$ may be determined. When step 412 is included, the method may further include step 414, at which, for each reflection, that reflection is removed from each spatial source distribution estimate $\hat{Y}(\omega_k)$ to produce an estimate $\hat{W}_r(\omega_k)$ of an additional noise and interference source distribution.

At step 416, the method includes generating an estimate $\hat{S}_n(\omega_k)$ of a noise and interference covariance matrix for each noise and interference spatial source distribution estimate $\hat{W}(\omega_k)$. The noise and interference covariance matrix estimate $\hat{S}_n(\omega_k)$ may be generated as in the description of FIG. 1 above.

FIG. 6 is a continuation 500 of the flowchart of the method 400 of FIG. 5. At step 502, in embodiments in which at least one additional noise and interference source distribution estimate $\hat{W}_r(\omega_k)$ is produced from each source distribution $Y(\omega_k)$, the method may include generating an additional noise and interference covariance matrix estimate $\hat{S}_{n,r}(\omega_k)$ for each additional noise and interference spatial source distribution estimate $\hat{W}_r(\omega_k)$. The one or more additional noise and interference covariance matrix estimates $\hat{S}_{n,r}(\omega_k)$ may be generated similarly to the noise and interference covariance matrix estimate $\hat{S}_n(\omega_k)$ of the signal of interest, but from $\hat{W}_r(\omega_k)$ instead of $\hat{W}(\omega_k)$.

At step 504, the method includes generating a beamformer configured to remove the noise and interference from the acoustic data. The noise and interference at each frequency are identified using the noise and interference covariance matrix estimate $\hat{S}_n(\omega_k)$ for that frequency.

At step 506, in embodiments in which an estimate of at least one additional noise and interference covariance matrix estimate $\hat{S}_{n,r}(\omega_k)$ is generated, the method may include generating at least one additional beamformer configured to remove the noise and interference from the acoustic data. Each additional beamformer may affect its corresponding reflection as though that reflection were the signal of interest, thus enhancing the signal-to-noise ratio of its corresponding reflection. For each additional beamformer, the noise and interference at each frequency may be identified using the additional noise and interference covariance matrix estimate $\hat{S}_{n,r}(\omega_k)$ for that frequency.

At step 508, the method may include generating an acoustic rake receiver using the beamformer of the signal of interest and the additional beamformer of each reflection. When the acoustic rake receiver is generated, a phase shift may be applied to each reflection so that constructive interference between the signal of interest and each reflection is maximized, in comparison to when a phase shift is not used. By constructively interfering the signal of interest with its reflections, the acoustic rake receiver may increase the clarity (or signal-to-noise ratio) of the signal of interest.

In some embodiments, the methods and processes described herein may be tied to a computing system of one or more computing devices. In particular, such methods and processes may be implemented as a computer-application program or service, an application-programming interface (API), a library, and/or other computer-program product.

Figure 7:
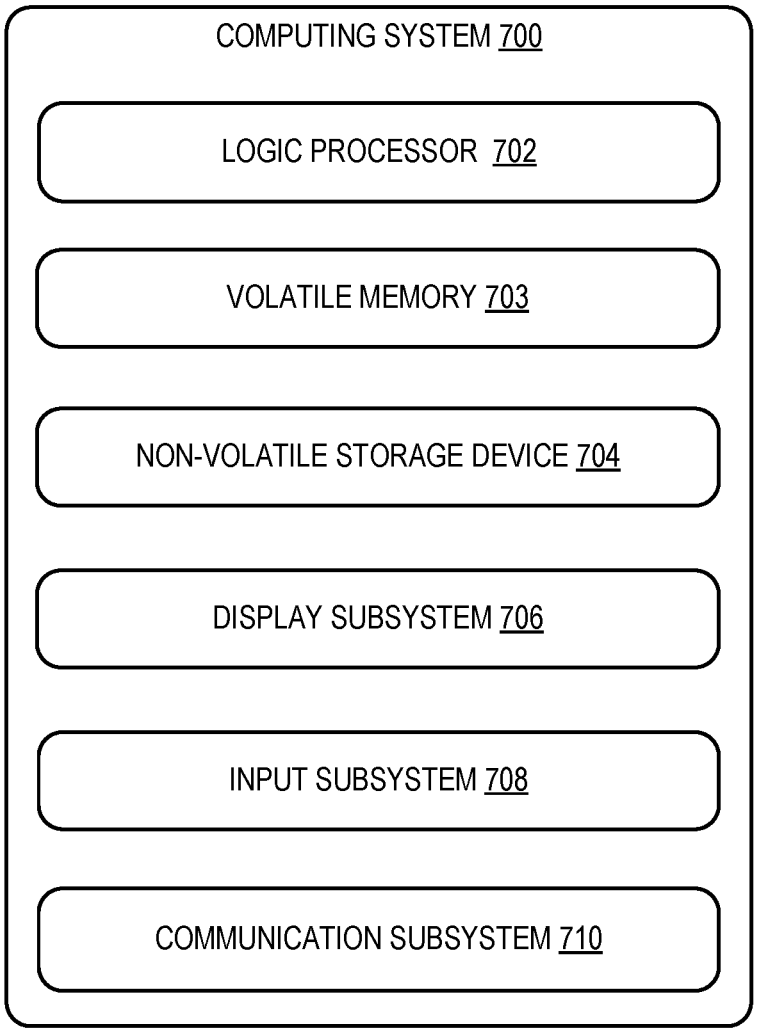
FIG. 7 shows an example computing system, according to one embodiment of the present disclosure.

FIG. 7 schematically shows a non-limiting embodiment of a computing system 700 that can enact one or more of the methods and processes described above. Computing system 700 is shown in simplified form. Computing system 700 may embody the computing device 10 of FIG. 1. Computing system 700 may take the form of one or more personal computers, server computers, tablet computers, home-entertainment computers, network computing devices, gaming devices, mobile computing devices, mobile communication devices (e.g., smart phone), and/or other computing devices, and wearable computing devices such as smart wristwatches and head mounted augmented reality devices.

Computing system 700 includes a logic processor 702 volatile memory 703, and a non-volatile storage device 704. Computing system 700 may optionally include a display subsystem 706, input subsystem 708, communication subsystem 710, and/or other components not shown in FIG. 7.

Logic processor 702 includes one or more physical devices configured to execute instructions. For example, the logic processor 702 may be configured to execute instructions that are part of one or more applications, programs, routines, libraries, objects, components, data structures, or other logical constructs. Such instructions may be implemented to perform a task, implement a data type, transform the state of one or more components, achieve a technical effect, or otherwise arrive at a desired result.

The logic processor 702 may include one or more physical processors (hardware) configured to execute software instructions. Additionally or alternatively, the logic processor 702 may include one or more hardware logic circuits or firmware devices configured to execute hardware-implemented logic or firmware instructions. Processors of the logic processor 702 may be single-core or multi-core, and the instructions executed thereon may be configured for sequential, parallel, and/or distributed processing. Individual components of the logic processor 702 optionally may be distributed among two or more separate devices, which may be remotely located and/or configured for coordinated processing. Aspects of the logic processor 702 may be virtualized and executed by remotely accessible, networked computing devices configured in a cloud-computing configuration. In such a case, these virtualized aspects are run on different physical logic processors of various different machines, it will be understood.

Non-volatile storage device 704 includes one or more physical devices configured to hold instructions executable by the logic processor 702 to implement the methods and processes described herein. When such methods and processes are implemented, the state of non-volatile storage device 704 may be transformed—e.g., to hold different data.

Non-volatile storage device 704 may include physical devices that are removable and/or built-in. Non-volatile storage device 704 may include optical memory (e.g., CD, DVD, HD-DVD, Blu-Ray Disc, etc.), semiconductor memory (e.g., ROM, EPROM, EEPROM, FLASH memory, etc.), and/or magnetic memory (e.g., hard-disk drive, floppy-disk drive, tape drive, MRAM, etc.), or other mass storage device technology. Non-volatile storage device 704 may include nonvolatile, dynamic, static, read/write, read-only, sequential-access, location-addressable, file-addressable, and/or content-addressable devices. It will be appreciated that non-volatile storage device 704 is configured to hold instructions even when power is cut to the non-volatile storage device 704.

Volatile memory 703 may include physical devices that include random access memory. Volatile memory 703 is typically utilized by logic processor 702 to temporarily store information during processing of software instructions. It will be appreciated that volatile memory 703 typically does not continue to store instructions when power is cut to the volatile memory 703.

Aspects of logic processor 702, volatile memory 703, and non-volatile storage device 704 may be integrated together into one or more hardware-logic components. Such hardware-logic components may include field-programmable gate arrays (FPGAs), program- and application-specific integrated circuits (PASIC/ASICs), program- and application-specific standard products (PSSP/ASSPs), system-on-a-chip (SOC), and complex programmable logic devices (CPLDs), for example.

The terms "module," "program," and "engine" may be used to describe an aspect of computing system 700 typically implemented in software by a processor to perform a particular function using portions of volatile memory, which function involves transformative processing that specially configures the processor to perform the function. Thus, a module, program, or engine may be instantiated via logic processor 702 executing instructions held by non-volatile storage device 704, using portions of volatile memory 703. It will be understood that different modules, programs, and/or engines may be instantiated from the same application, service, code block, object, library, routine, API, function, etc. Likewise, the same module, program, and/or engine may be instantiated by different applications, services, code blocks, objects, routines, APIs, functions, etc. The terms "module," "program," and "engine" may encompass individual or groups of executable files, data files, libraries, drivers, scripts, database records, etc.

When included, display subsystem 706 may be used to present a visual representation of data held by non-volatile storage device 704. The visual representation may take the form of a graphical user interface (GUI). As the herein described methods and processes change the data held by the non-volatile storage device, and thus transform the state of the non-volatile storage device, the state of display subsystem 706 may likewise be transformed to visually represent changes in the underlying data. Display subsystem 706 may include one or more display devices utilizing virtually any type of technology. Such display devices may be combined with logic processor 702, volatile memory 703, and/or non-volatile storage device 704 in a shared enclosure, or such display devices may be peripheral display devices.

When included, input subsystem 708 may comprise or interface with one or more user-input devices such as a keyboard, mouse, touch screen, or game controller. In some embodiments, the input subsystem may comprise or interface with selected natural user input (NUI) componentry. Such componentry may be integrated or peripheral, and the transduction and/or processing of input actions may be handled on- or off-board. Example NUI componentry may include a microphone for speech and/or voice recognition; an infrared, color, stereoscopic, and/or depth camera for machine vision and/or gesture recognition; a head tracker, eye tracker, accelerometer, and/or gyroscope for motion detection and/or intent recognition; as well as electric-field sensing componentry for assessing brain activity; and/or any other suitable sensor.

When included, communication subsystem 710 may be configured to communicatively couple various computing devices described herein with each other, and with other devices. Communication subsystem 710 may include wired and/or wireless communication devices compatible with one or more different communication protocols. As non-limiting examples, the communication subsystem may be configured for communication via a wireless telephone network, or a wired or wireless local- or wide-area network, such as a HDMI over Wi-Fi connection. In some embodiments, the communication subsystem may allow computing system 700 to send and/or receive messages to and/or from other devices via a network such as the Internet.

According to one aspect of the present disclosure, a computing device is provided, comprising a processor configured to receive from a microphone array a set of measurements of a vector x of acoustic data, including noise, interference, and a signal of interest. The processor may be further configured to apply a transform to the measurements so that x is expressed in a frequency domain, wherein the frequency is discretized in a plurality of intervals. For each interval, the processor may be configured to generate an estimate $\hat{S}_x$ of a covariance matrix of x. For each covariance matrix estimate $\hat{S}_x$, the processor may be further configured to use acoustic imaging to obtain an estimate $\hat{Y}$ of a spatial source distribution. For each spatial source distribution estimate $\hat{Y}$, the processor may be further configured to remove the signal of interest to produce an estimate $\hat{W}$ of a noise and interference spatial source distribution. For each noise and interference spatial source distribution estimate $\hat{W}$, the processor may be further configured to generate an estimate $\hat{S}_n$ of a noise and interference covariance matrix. The processor may generate a beamformer configured to remove the noise and interference from the acoustic data, wherein the noise and interference at each frequency are identified using the noise and interference covariance matrix estimate $\hat{S}_n$ for that frequency.

According to this aspect, the transform applied to the acoustic data may be a fast Fourier transform.

According to this aspect, the use of acoustic imaging may include a fast array transform.

According to this aspect, the processor may be configured to remove the signal of interest from each spatial source distribution estimate $\hat{Y}$ using image segmentation.

According to this aspect, the processor may be configured to generate the noise and interference covariance matrix estimate $\hat{S}_n$ from $\hat{W}$ using a fast array transform. According to this aspect, the fast array transform may be selected from the group consisting of a Kronecker array transform (KAT), a fast non-equispaced Fourier transform (NFFT), and a fast non-equispaced in time and frequency Fourier transform (NNFFT).

According to this aspect, the processor may be configured to use acoustic imaging to obtain each spatial source distribution estimate $\hat{Y}$ using a physical model of sound propagation A.

According to this aspect, the beamformer may be a minimum variance directional response (MVDR) beamformer.

According to this aspect, the processor may be configured to determine a location of one or more sources of interference. According to this aspect, the beamformer may have a unity gain response toward the signal of interest and a spatial null toward each source of interference.

According to this aspect, the processor may be configured to determine locations of one or more reflections of the signal of interest in the spatial source distribution estimate $\hat{Y}$. According to this aspect, for each reflection, the processor may be configured to, for each spatial source distribution estimate $\hat{Y}$, remove the reflection to produce an additional estimate $\hat{W}_r$ of the noise and interference source distribution. For each additional noise and interference source distribution estimate $\hat{W}_r$, the processor may be configured to generate an estimate $\hat{S}_{n,r}$ of an additional noise and interference covariance matrix. The processor may be further configured to generate an additional beamformer configured to remove the noise and interference from the acoustic data, wherein the noise and interference at each frequency are identified using the additional noise and interference covariance matrix estimate $\hat{S}_{n,r}$ for that frequency. The processor may be further configured to generate an acoustic rake receiver using the beamformer of the signal of interest and the additional beamformer of each reflection, wherein a phase shift is applied to align each reflection with respect to the signal of interest, so that a signal-to-noise ratio of a sum of the signal of interest and each reflection is maximized.

According to another aspect of the present disclosure, a method for use with a computing device is provided, comprising receiving from a microphone array a set of measurements of a vector x of acoustic data, including noise, interference, and a signal of interest. The method may further include applying a transform to the measurements so that x is expressed in a frequency domain, wherein the frequency is discretized in a plurality of intervals. For each interval, the method may include generating an estimate $\hat{S}_x$ of a covariance matrix of x. For each covariance matrix estimate $\hat{S}_x$, the method may further include using acoustic imaging to obtain an estimate $\hat{Y}$ of a spatial source distribution. For each spatial source distribution estimate $\hat{Y}$, the method may further include removing the signal of interest to produce an estimate $\hat{W}$ of a noise and interference spatial source distribution. For each noise and interference spatial source distribution estimate $\hat{W}$, the method may further include generating an estimate $\hat{S}_n$ of a noise and interference covariance matrix. The method may further include generating a beamformer configured to remove the noise and interference from the acoustic data, wherein the noise and interference at each frequency are identified using the noise and interference covariance matrix estimate $\hat{S}_n$ for that frequency.

According to this aspect, the transform applied to the acoustic data may be a fast Fourier transform.

According to this aspect, the use of acoustic imaging may include a fast array transform.

According to this aspect, the signal of interest may be removed from each spatial source distribution estimate $\hat{Y}$ using image segmentation.

According to this aspect, the noise and interference covariance matrix estimate $\hat{S}_n$ may be generated from $\hat{W}$ using a fast array transform.

According to this aspect, locations of one or more reflections of the signal of interest in the spatial source distribution estimate $\hat{Y}$ may be determined. According to this aspect, for each reflection, the method may include, for each spatial source distribution estimate $\hat{Y}$, removing the reflection to produce an estimate $\hat{W}_r$ of an additional noise and interference source distribution. For each additional noise and interference source distribution estimate $\hat{W}_r$, the method may further include generating an estimate $\hat{S}_{n,r}$ of an additional noise and interference covariance matrix. The method may further include generating an additional beamformer configured to remove the noise and interference from the acoustic data, wherein the noise and interference at each frequency are identified using the additional noise and interference covariance matrix estimate $\hat{S}_{n,r}$ for that frequency. The method may further include generating an acoustic rake receiver using the beamformer of the signal of interest and the additional beamformer of each reflection, wherein a phase shift is applied to align each reflection with respect to the signal of interest, so that a signal-to-noise ratio of a sum of the signal of interest and each reflection is maximized.

According to another aspect of the present disclosure, a computing device is provided, comprising a processor configured to receive from a microphone array a set of measurements of a vector x of acoustic data, including noise, interference, and a signal of interest. The processor may be configured to apply a transform to the measurements so that x is expressed in a frequency domain, wherein the frequency is discretized in a plurality of intervals. For each interval, the processor may be further configured to generate an estimate $\hat{S}_x$ of a covariance matrix of x. For each covariance matrix estimate $\hat{S}_x$, the processor may be configured to use acoustic imaging to obtain an estimate $\hat{Y}$ of a source distribution. The processor may be further configured to determine a location of one or more sources of interference. The processor may be further configured to generate a beamformer with a unity gain response toward the signal of interest and a spatial null toward each source of interference.

It will be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated and/or described may be performed in the sequence illustrated and/or described, in other sequences, in parallel, or omitted. Likewise, the order of the above-described processes may be changed.

The subject matter of the present disclosure includes all novel and non-obvious combinations and sub-combinations of the various processes, systems and configurations, and other features, functions, acts, and/or properties disclosed herein, as well as any and all equivalents thereof.

The invention claimed is:

1. A computing device, comprising a processor configured to:

receive from a microphone array a set of measurements of a vector x of acoustic data, including noise, interference, and a signal of interest;

apply a transform to the measurements so that x is expressed in a frequency domain, wherein the frequency is discretized in a plurality of intervals;

for each interval, generate an estimate $\hat{S}_x$ of a covariance matrix of x;

for each covariance matrix estimate $\hat{S}_x$, use acoustic imaging to obtain an estimate $\hat{Y}$ of a spatial source distribution;

for each spatial source distribution estimate $\hat{Y}$, remove the signal of interest to produce an estimate $\hat{W}$ of a noise and interference spatial source distribution;

for each noise and interference spatial source distribution estimate $\hat{W}$, generate an estimate $\hat{S}_n$ of a noise and interference covariance matrix; and generate a beamformer configured to remove the noise and interference from the acoustic data, wherein the noise and interference at each frequency are identified using the noise and interference covariance matrix estimate $\hat{S}_n$ for that frequency.

2. The computing device of claim 1, wherein the transform applied to the acoustic data is a fast Fourier transform.

3. The computing device of claim 1, wherein the use of acoustic imaging includes a fast array transform.

4. The computing device of claim 1, wherein the processor is configured to remove the signal of interest from each spatial source distribution estimate $\hat{Y}$ using image segmentation.

5. The computing device of claim 1, wherein the processor is configured to generate the noise and interference covariance matrix estimate $\hat{S}_n$ from $\hat{W}$ using a fast array transform.

6. The computing device of claim 5, wherein the fast array transform is selected from the group consisting of a Kronecker array transform (KAT), a fast non-equispaced Fourier transform (NFFT), and a fast non-equispaced in time and frequency Fourier transform (NNFFT).

7. The computing device of claim 1, wherein the processor is configured to use acoustic imaging to obtain each spatial source distribution estimate $\hat{Y}$ using a physical model of sound propagation A.

8. The computing device of claim 1, wherein the beamformer is a minimum variance directional response (MVDR) beamformer.

9. The computing device of claim 1, wherein the processor is configured to determine a location of one or more sources of interference.

10. The computing device of claim 9, wherein the beamformer has a unity gain response toward the signal of interest and a spatial null toward each source of interference.

11. The computing device of claim 1, wherein the processor is configured to determine locations of one or more reflections of the signal of interest in the spatial source distribution estimate $\hat{Y}$.

12. The computing device of claim 11, wherein, for each reflection, the processor is configured to:

for each spatial source distribution estimate $\hat{Y}$, remove the reflection to produce an additional estimate $\hat{W}_r$ of the noise and interference source distribution;

for each additional noise and interference source distribution estimate $\hat{W}_r$, generate an estimate $\hat{S}_{n,r}$ of an additional noise and interference covariance matrix;

generate an additional beamformer configured to remove the noise and interference from the acoustic data, wherein the noise and interference at each frequency are identified using the additional noise and interference covariance matrix estimate $\hat{S}_{n,r}$ for that frequency; and generate an acoustic rake receiver using the beamformer of the signal of interest and the additional beamformer of each reflection, wherein a phase shift is applied to align each reflection with respect to the signal of interest, so that a signal-to-noise ratio of a sum of the signal of interest and each reflection is maximized.

13. A method for use with a computing device, comprising:

receiving from a microphone array a set of measurements of a vector x of acoustic data, including noise, interference, and a signal of interest;

applying a transform to the measurements so that x is expressed in a frequency domain, wherein the frequency is discretized in a plurality of intervals;

for each interval, generating an estimate $\hat{S}_x$ of a covariance matrix of x;

for each covariance matrix estimate $\hat{S}_x$, using acoustic imaging to obtain an estimate $\hat{Y}$ of a spatial source distribution;

for each spatial source distribution estimate $\hat{Y}$, removing the signal of interest to produce an estimate $\hat{W}$ of a noise and interference spatial source distribution;

for each noise and interference spatial source distribution estimate $\hat{W}$, generating an estimate $\hat{S}_n$ of a noise and interference covariance matrix; and generating a beamformer configured to remove the noise and interference from the acoustic data, wherein the noise and interference at each frequency are identified using the noise and interference covariance matrix estimate $\hat{S}_n$ for that frequency.

14. The method of claim 13, wherein the transform applied to the acoustic data is a fast Fourier transform.

15. The method of claim 13, wherein the use of acoustic imaging includes a fast array transform.

16. The method of claim 13, wherein the signal of interest is removed from each spatial source distribution estimate $\hat{Y}$ using image segmentation.

17. The method of claim 13, wherein the noise and interference covariance matrix estimate $\hat{S}_n$ is generated from $\hat{W}$ using a fast array transform.

18. The method of claim 13, wherein locations of one or more reflections of the signal of interest in the spatial source distribution estimate $\hat{Y}$ are determined.

19. The method of claim 18, further including, for each reflection:

for each spatial source distribution estimate $\hat{Y}$, removing the reflection to produce an estimate $\hat{W}_r$ of an additional noise and interference source distribution;

for each additional noise and interference source distribution estimate $\hat{W}_r$, generating an estimate $\hat{S}_{n,r}$ of an additional noise and interference covariance matrix;

generating an additional beamformer configured to remove the noise and interference from the acoustic data, wherein the noise and interference at each frequency are identified using the additional noise and interference covariance matrix estimate $\hat{S}_{n,r}$ for that frequency; and generating an acoustic rake receiver using the beamformer of the signal of interest and the additional beamformer of each reflection, wherein a phase shift is applied to align each reflection with respect to the signal of interest, so that a signal-to-noise ratio of a sum of the signal of interest and each reflection is maximized.

20. A computing device, comprising a processor configured to:

receive from a microphone array a set of measurements of a vector x of acoustic data, including noise, interference, and a signal of interest;

apply a transform to the measurements so that x is expressed in a frequency domain, wherein the frequency is discretized in a plurality of intervals;

for each interval, generate an estimate $\hat{S}_x$ of a covariance matrix of x;

for each covariance matrix estimate $\hat{S}_x$, use acoustic imaging to obtain an estimate $\hat{Y}$ of a source distribution;

determine a location of one or more sources of interference at least in part by removing the signal of interest from each estimate $\hat{Y}$ of the source distribution; and generate a beamformer with a unity gain response toward the signal of interest and a spatial null toward each source of interference.

* * * * *